US007108026B2

(12) United States Patent
Luca

(10) Patent No.: US 7,108,026 B2
(45) Date of Patent: Sep. 19, 2006

(54) PORTABLE FUEL DELIVERY APPARATUS

(76) Inventor: Robert Luca, 4 Sunnyside Pl., Irvington, NY (US) 10533

( * ) Notice: Subject to any disclaimer, the term of this patent is extended or adjusted under 35 U.S.C. 154(b) by 0 days.

(21) Appl. No.: 10/977,619

(22) Filed: Oct. 27, 2004

(65) Prior Publication Data

US 2006/0086411 A1 Apr. 27, 2006

(51) Int. Cl.
*B65B 1/04* (2006.01)

(52) U.S. Cl. ..... 141/231; 141/18; 141/94; 141/392

(58) Field of Classification Search ..... 141/18, 141/94, 95, 231, 388, 391, 392; 73/113, 73/116; 417/63
See application file for complete search history.

(56) References Cited

U.S. PATENT DOCUMENTS 3,904,116 A * 9/1975 Jones et al. ..... 239/127
4,602,599 A * 7/1986 Glagola ..... 123/179.9
5,386,721 A * 2/1995 Alvizar ..... 73/116

* cited by examiner

*Primary Examiner*—Timothy L. Maust
(74) *Attorney, Agent, or Firm*—Fulbright & Jaworski LLP

(57) ABSTRACT

The portable fuel delivery apparatus for temporarily providing fuel to disabled machines, such as motor vehicles. The apparatus comprises a container for housing the fuel, a hose for discharging the fuel from said container, an electric pump inside said container for pumping the fuel from the container through said hose, and a pair of wires to connect said electric pump to a power source.

9 Claims, 2 Drawing Sheets

1250
1000

1250
FUEL HOSE
100
1600
FUEL FILLER CAP
1500
1700
Fuel Pressure Regulator
ON
OFF
1400
Fuel Pressure Gauge
1800
1000

1350
1000
1350

PORTABLE FUEL DELIVERY APPARATUS

BACKGROUND OF THE INVENTION

The present invention relates to a portable device for providing temporary fuel to a disabled motor device. More specifically, the present invention relates to a portable fuel delivery apparatus for temporarily providing fuel to a disabled motor vehicle.

Most cars built in the last twenty-five years, no longer have carburetors, but use fuel injectors instead. The fuel injection system requires the fuel to be delivered to the engine at a higher pressure than required for the carburetors. Accordingly, the high pressure electrical fuel pumps have been steadily replacing the mechanical fuel pumps. When a motor vehicle is disabled, e.g., resulting from an electrical fuel pump failure, the disabled vehicle is towed to a repair shop. Typically the disabled vehicle sits in a lot outside the repair shop until it is ready to be worked on by a mechanic. The problem is getting the disabled vehicle from where it was dropped off in the lot into the repair shop. Therefore, it is desirable to have a device that can be attached to a disable vehicle for enabling the vehicle to be started and driven into the repair shop.

OBJECTS AND SUMMARY OF THE INVENTION

Therefore, it is an object of the present invention to provide a portable fuel delivery apparatus which overcomes the problems noted herein.

In accordance with an embodiment of the present invention, the portable fuel delivery apparatus comprises a container for housing the fuel, a hose for discharging the fuel from said container, an electric pump inside said container for pumping the fuel from the container through said hose, and a pair of wires to connect said electric pump to a power source.

In accordance with an embodiment of the present invention, the portable fuel delivery apparatus comprises an electric fuel pump enclosed in a fuel container, a hose and two electric wires or cables. The hose connected to the fuel pump and extending out of the container is used to deliver the fuel to the disabled motor vehicle. The electric fuel pump is powered by the disabled vehicle's battery via the two electric cables.

In accordance with another embodiment of the present invention, the portable fuel delivery apparatus as aforesaid additionally comprises a battery enclosed in the fuel container for powering the electric fuel pump and a switch for activating the fuel pump.

In accordance with a further embodiment of the present invention, the portable fuel delivery apparatus as aforesaid additionally comprises a fuel pressure regulator for controlling or regulating the pressure or amount of fuel outputted from the portable fuel delivery apparatus.

In accordance with a yet another embodiment of the present invention, the portable fuel delivery apparatus as aforesaid additionally comprises a fuel pressure gauge for measuring the pressure of fuel outputted from the portable fuel delivery apparatus.

Various other objects, advantages and features of the present invention will become readily apparent from the ensuing detailed description, and the novel features will be particularly pointed out in the appended claims.

BRIEF DESCRIPTION OF THE DRAWINGS

The following detailed description, given by way of example, and not intended to limit the present invention solely thereto, will be best be understood in conjunction with the accompanying drawings.

DETAILED DESCRIPTION

The present invention is readily implemented by presently available electrical components. The invention finds ready application in virtually all fuel based machines, including but not limited to motor vehicles (i.e., cars, trucks, motorcycles, mopeds, tractors, all terrain vehicles (ATV), and the like), jet skis, boats, lawn mowers, generators, boilers, and the like.

Figure 1:
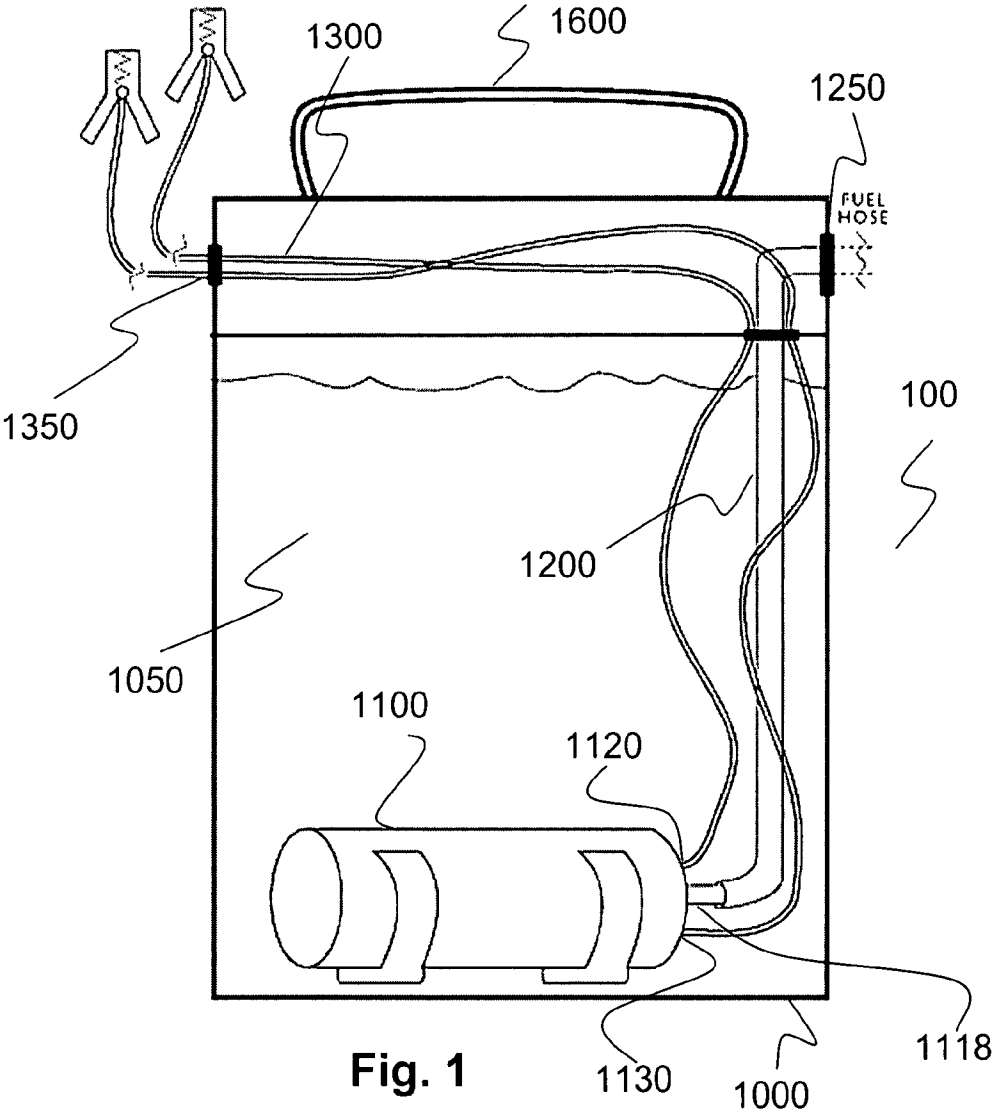
FIG. 1 is an internal perspective view of a fuel pack in accordance with an embodiment of the present invention.

In accordance with an embodiment of the present invention, as shown in FIG. 1, the portable fuel delivery apparatus or fuel pack 100 comprises an electric fuel pump 1100 enclosed in a fuel container or can 1000, a hose 1200 and two electric wires or cables 1300. It is appreciated that the fuel can or container 1000 can be made of metal, plastic, polyethylene, vinyl and the like capable of holding a small quantity of fuel 1050, such as one to two gallons. In accordance with an aspect of the present invention, the fuel container 1000 comprises a fuel filling opening for re-filling the fuel container 1000. Typically, the fuel filling opening is closed with a fuel filler cap 1500 to prevent the fuel from spilling out of the fuel container 1000. Preferably, the fuel container 1000 includes a vent cap (not shown) and complies with governmental regulations and standards, such as ANSI/ASTM F852–86. In accordance with another aspect of the present invention, the fuel container 1000 comprises a handle 1600. For example, the handle 1600 can be built into the top of the fuel container 1600. It is appreciated that the handle 1600 and the fuel container 1000 can be made as one piece from a single mold.

The electric fuel pump 1100 outputs or pumps the fuel 1050 in the container 1000 out via a hose 1200 connected to the outlet side 1110 of the electric fuel pump 1100 and extending, e.g., 5–6 ft., out of the fuel container 1000. It is appreciated that the hose 1200 will extend out of the container 1000 sufficient for an operator to connect the hose 1200 to the inlet port of the fuel based apparatus (not shown), such as the fuel rail of a motor vehicle. In accordance with an aspect of the present invention, one end (i.e., the near end) of the hose 1200 is attached to the outlet side of the electric fuel pump 100 and the other end (i.e., the far end) of the hose 1200 exits the fuel container 1000 near the top through an opening 1250 (see FIGS. 2B–C) on the container 1000. Preferably, the hose 1200 includes a cover, a cap or other comparable closing means (not shown) to close the far end of the hose 1200 when the portable fuel pack 100 is not in use. In accordance with an aspect of the present invention, the hose 1200 is a stretchable hose such that the far end of the hose 1200 is near the opening 1250 and the operator pulls or stretches the hose 1200 to connect to the inlet port of the fuel based apparatus, such as the fuel rail of a motor vehicle.

Two electric cables or wires 1300 connected to a positive terminal/side 1120 and a negative terminal/side 1130 of the electric pump 1100 and extending, e.g., 5–6 ft., out of the fuel container 1000 can be connected to an external power source (not shown), such as the 12 volt car battery. In accordance with an aspect of the present invention, the electric wires/cables 1300 exit the fuel container 1000 through an opening 1350 (see FIGS. 2A–B) near the top of the fuel container 1000. Preferably, the electric wires/cables 1300 is a stretchable wires/cables such that the far end of the electric wires/cables 1300 is near the opening 1350 and the operator pulls or stretches the electric wires/cables 1300 to connect to a power source. For example, as shown in FIGS. 1 and 2B, the opening 1350 for the electric wires 1300 can be located on the opposite side of the fuel container 1000 from the opening 1250 for the fuel hose 1200.

In accordance with an embodiment of the present invention, the fuel container 1000 comprises an internal power source 1900, thereby eliminating the need for electric cables/wires 1300 and the opening 1350. Preferably, as shown in FIG. 2B, a switch 1400 is located on the outer surface of the fret container 1000 to activate the fuel pump 1100.

Figures 2A, 2B, 2C:
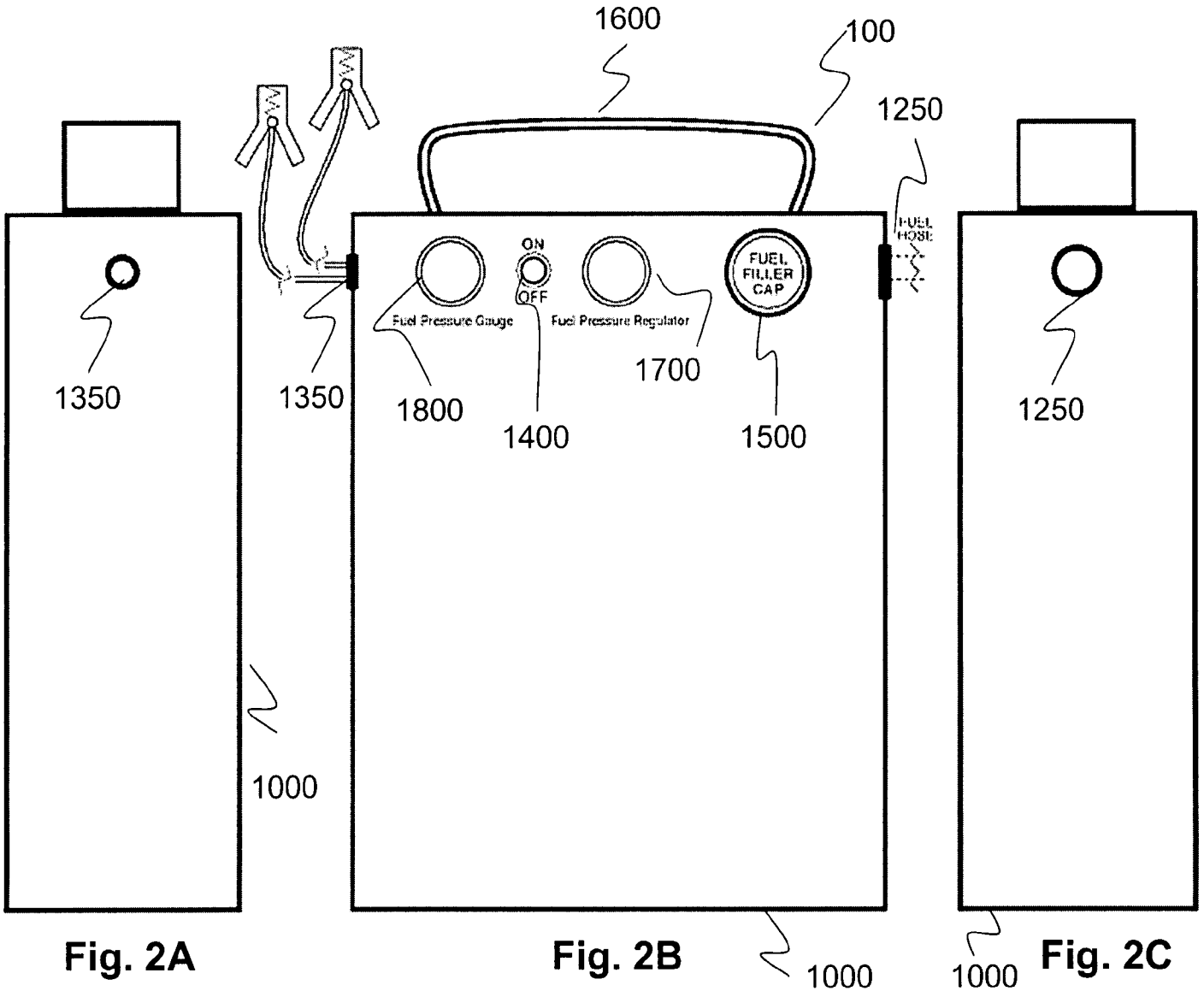
FIGS. 2A–2C are perspective views of the fuel pack in accordance with an embodiment of the present invention.

In accordance with an embodiment of the present invention, as shown in FIG. 2B, the fuel pack 100 comprises a fuel pressure regulator 1700 to control or regulate the pressure or amount of fuel outputted from the fuel container 1000 to the fuel based device apparatus, such as a fuel rail of a car.

In accordance with an embodiment of the present invention, as shown in FIG. 2B, the fuel pack 100 comprises a fuel pressure gauge 1800 to measure the pressure of the fuel outputted from the fuel container 1000 to the fuel based device apparatus, such as a fuel rail of a car.

In accordance with an embodiment of the present invention, the operation of the portable fuel delivery apparatus or fuel pack 100 for use with a disabled vehicle is described herein. When a vehicle is disabled due to fuel delivery related problems, e.g., faulty fuel pump, the operator, driver or mechanic can connect the fuel pack 100 to the disabled vehicle to operate the vehicle for a short time, such as driving the vehicle to a repair shop, rest stop, a garage bay to be put on the hydraulic lifts. It is appreciated that the fuel pack 100 can be similarly used to temporarily operate a generator or boiler until it can be repaired, and the like.

In accordance with an embodiment of the present invention, the portable fuel delivery apparatus or fuel pack 100 can be used as a diagnostic tool to determine if the vehicle's problem is related to the fuel system, such as a defective fuel pump.

While the present invention has been particularly described with respect to the illustrated embodiment, it will be appreciated that various alterations, modifications and adaptations may be made based on the present disclosure, and are intended to be within the scope of the present invention. It is intended that the appended claims be interpreted as including the embodiment discussed above, those various alternatives, which have been described and all equivalents thereto.

What is claimed is:

1. A portable fuel delivery apparatus, comprising:

a container for housing the fuel:

a hose for discharging the fuel from said container;

an electric pump inside said container for pumping the fuel from the container through said hose to provide temporary supply of fuel to a disabled vehicle;

an internal power source in said container and connected to said pump for providing power to said pump: and a fuel pressure regulator on an outer surface of said container for controlling the pressure of the fuel discharged from said container.

2. The portable fuel delivery apparatus of claim 1, wherein said container includes a handle.

3. The portable fuel delivery apparatus of claim 1, further comprising a pair of wires for connecting said pump to an external power source.

4. The portable fuel delivery apparatus of claim 3, wherein said external power source is a vehicle battery.

5. The portable delivery apparatus of claim 1, further comprising a switch on an outer surface of said container for activating said pump.

6. The portable fuel delivery apparatus of claim 1, wherein said fuel pressure regulator controls the amount of the fuel discharged from said container.

7. The portable fuel delivery apparatus of claim 1, further comprising a fuel pressure gauge on an outer surface of said container for measuring the pressure of the fuel discharged from said container.

8. The portable fuel delivery apparatus of claim 1, further comprising an opening for re-filling said container with the fuel.

9. The portable fuel delivery apparatus of claim 8, further comprising a cap for ciosiuig and opening said opening.

* * * * *